United States Patent [19]

Rast

[11] 4,425,783

[45] Jan. 17, 1984

[54] TUBE EXPANDING TOOL

[75] Inventor: Wlodzimierz Rast, North Adelaide, Australia

[73] Assignee: Ridge Tool Company, Elyria, Ohio

[21] Appl. No.: 247,295

[22] PCT Filed: Jul. 29, 1980

[86] PCT No.: PCT/AU80/00038

§ 371 Date: Mar. 27, 1981

§ 102(e) Date: Mar. 27, 1981

[87] PCT Pub. No.: WO81/00364

PCT Pub. Date: Feb. 19, 1981

[30] Foreign Application Priority Data

Jul. 30, 1979 [AU] Australia ..... PD9783

[51] Int. Cl.[3] ..... B21D 41/02

[52] U.S. Cl. ..... 72/393; 72/409; 72/452

[58] Field of Search ..... 72/393, 409, 450, 452, 72/451; 81/355, 361, 362; 74/105, 107

[56] References Cited

U.S. PATENT DOCUMENTS

| | | | |
|---|---|---|---|
| 291,775 | 1/1884 | Rice | 74/107 |
| 2,999,529 | 9/1961 | Rast | 72/393 |
| 4,164,135 | 8/1979 | Clavin | 72/466 |

*Primary Examiner*—Lowell A. Larson

*Attorney, Agent, or Firm*—Robert E. Burns; Emmanuel J. Lobato; Bruce L. Adams

[57] ABSTRACT

A tube expanding tool of a type having a body (1) with a pair of handles (3,26) arranged to move a tapered drift (15) into radially expandable jaws, characterized by a push rod (17) hingedly connected to the drift (15) and engaging a cam face (25) on the handle (26) pivoted on the body (1) to have the point of contact between the face (27) on the push rod (17) and the cam face (25) of the lever (26) positioned on, or adjacent to, the axis of movement of the drift (15).

8 Claims, 7 Drawing Figures

TUBE EXPANDING TOOL

This invention relates to a tube expanding tool and in particular it relates to a tool of the type in which a series of radially expanding jaws are carried by a head fitted to a body which has on it handles whereby a drift can be manipulated to expand the jaws when the jaws are engaged on the tube which is to be expanded.

It is already known to construct tube expanding tools of this general nature and for instance according to an earlier tool, a body had on it a handle which projected therefrom and had hinged thereto another handle which had on it a cam face which engaged a drift axially slidable in the body, which drift was moved into expanding jaws carried on a head which was engageable on the body. By manipulating that handle which has the cam face on it the drift was forced inwards to expand the jaws.

In the earlier devices certain problems occurred because of the amount of expansion generally required and the relatively heavy force necessary to move the drift against the friction exerted on its tapered part by the jaws, which jaws require considerable radial force on them to xpand the tube.

Because of his it has been proposed according to an earlier invention to have the pivot of the handle, which has on it the cam face, movable along the axial line of the drift so that a first pressure moved the drift part way along its forward travel, after which the pivotal axis of the lever was moved forward and the drift moved forward further along its forward travel when the lever was actuated again.

The object of the invention is to provide a tool which does not necessarily require a multi-stage operation and in which certain other advantages will result, as will be apparent from the following description.

The tube expanding tool according to the present invention comprises a body having a first handle secured thereto and a second handle pivotally carried thereby, and a drift axially slidable therein into expandable jaws carried in a head mountable on the body, whereby to expand the jaws when the drift is moved thereinto, the invention being characterised by a push rod hingedly connected to the drift about an axis parallel to the axis of movement of the movable handle and positioned to engage a cam face on the movable handle in a position on or ner to the axis of movement of the drift.

The invention can be conveniently carried out by using a push rod hinged to the rear of the drift which has an arcuate face on it which engages a cam face on the inner end of the pivoted handle on or adjacent to the axis of movement of the drift, the handle preferably being mounted in such a way that at the commencement of the forward stroke of the drift that part of the face of the push rod which engages the cam face on the movable handle is on the pivotal axis of the handle.

Figure 1:
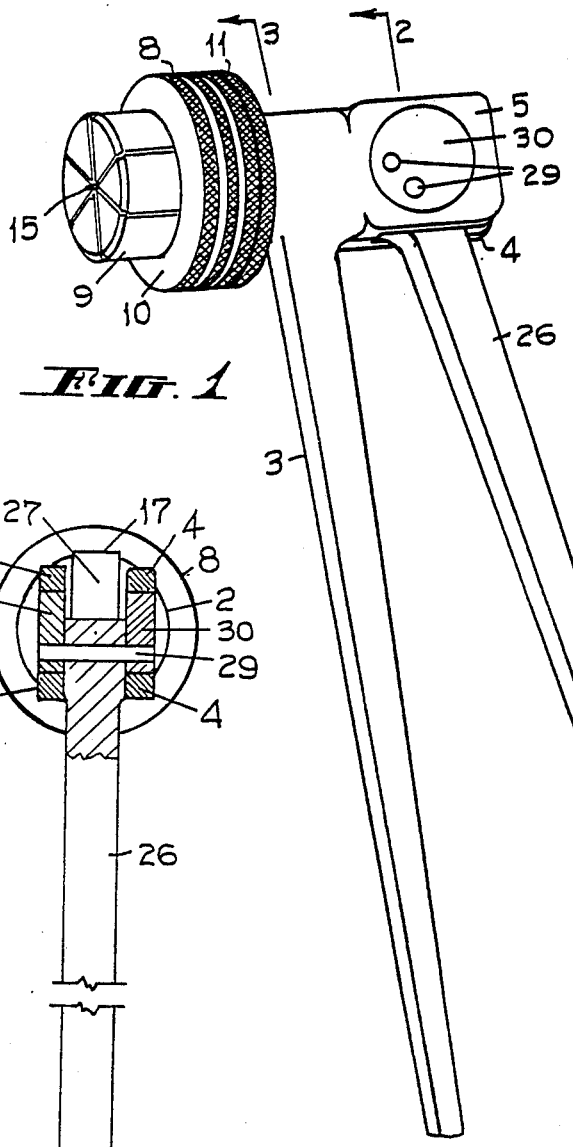
Figure 3:
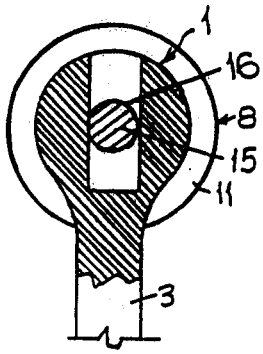
Figure 2:
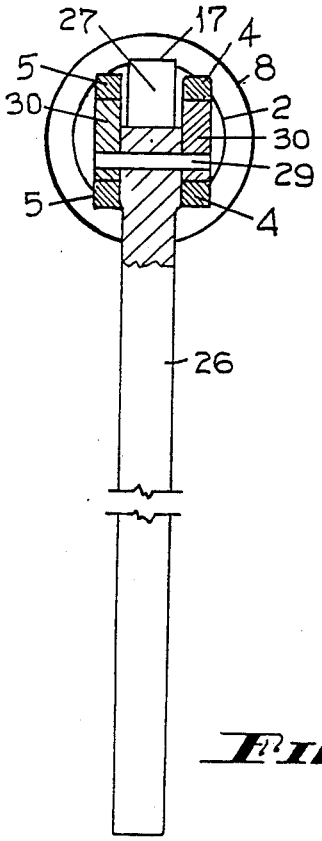
Figure 4:
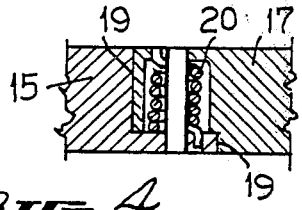
Figure 5:
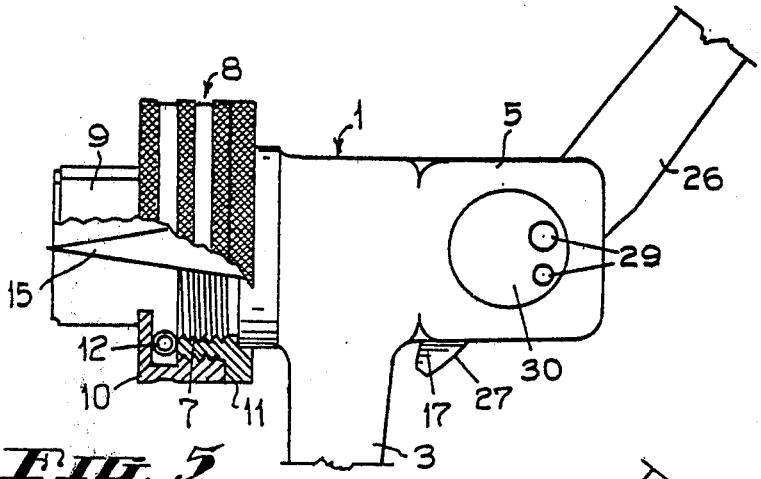
Figure 6:
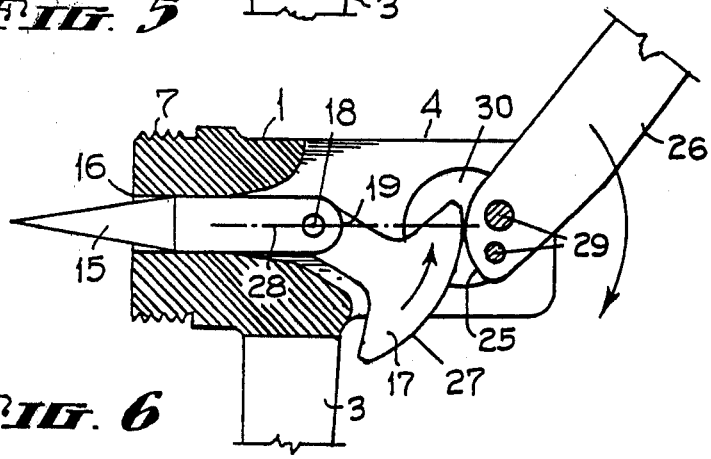
Figure 7:
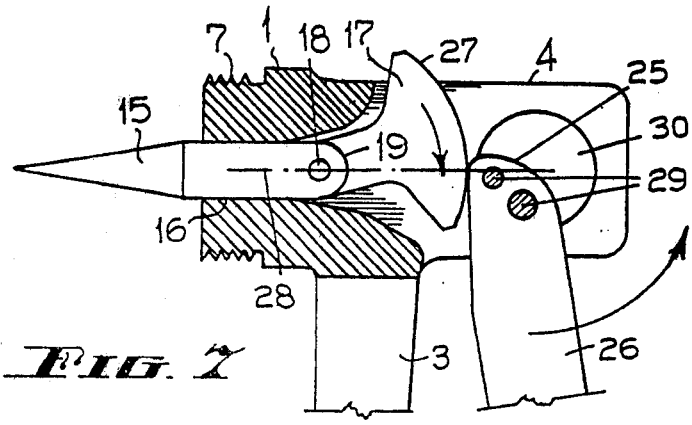

In order however that the nature of the invention can be fully appreciated an embodiment thereof will now be described with reference to the accompanying drawings in which:

FIG. 1 is a perspective view of a tube expanding tool constructed according to this invention, FIG. 2 is a transverse section of same on the plane of line 2 on FIG. 1, FIG. 3 is a fragmentary transverse section of same on the plane of line 2 of FIG. 1, FIG. 4 is a sectional enlarged fragmentary view of the articulation joint between the drift and the push rod, FIG. 5 is an enlarged fragmentarily sectioned side elevation of the tube expanding tool, FIG. 6 is a longitudinally sectioned view of the body showing the drift and the push rod and cam and handle assembly, the drift being shown in retracted position, and FIG. 7 is a similar view but with the drift in its advanced position.

The body 1 has on it a fixed handle 3, and includes two rearwardly projecting wings 4 and 5 which form support means for a second handle.

Engaged on this body by means of a screw thread 7 is a head 8 which supports on it a series of jaws 9 in any usual or approved manner, the jaws extending through an aperture in a keepr 10 which forms one part of the head 8 and which is engaged on a ring 11 which forms a second part of the head 8 and which ring 11 is internally screw-threaded to engage the screw thread 7 on the body 1, the jaws being urged inwards by a spring circlip 12 engaging a peripheral part of the jaws 9 inside of the keeper 10, The use of an attached head allows jaws of different dimensions to be readily fitted to the tool when required, it being necessary only to position a head having jaws of the required dimensions.

The drift 15 is located in a bore 16 in the body 1 and carries on its rear the push rod 17 which is located on a pin 18 which also engages the drift 15, which pin joins the drift 15 and the push rod 17 to form an articulated pressure-transmitting member. The pin 18 serves mainly as a locating pin, the stress being transmitted from the push rod 17 to the drift 15 by pressure-transmitting faces 19 on the push rod 17 and on the drift 15, which faces 19 are radiused about the pin 18.

The push rod is urged into the position shown in FIG. 5 and FIG. 6 by a helical spring 20, shown particularly in FIG. 4, disposed in a hollow in the push rod 17 and having its one end engaging the push rod 17 and its other end engaging the drift 15, the purpose of this being to ensure that before a stroke commences, at which stage the push rod 17 is not necessarily in contact with a cam face 25 on the movable handle 26, the push rod is in correct position to start a stroke.

The cam face 25 is formed on the second handle 26 so that contact between the cam face 25 and the face 27 on the push rod 17 which is shown radiused about the pin 18, is on the axis of movement of the drift 15, which axis is designated 28, so that any push exerted by the cam face 25, when the lever 26 is moved, is in the direction of movement of the drift 15. It will be appreciated that this materially reduces friction on the drift because it does not apply a force on the drift which is angular to the axis of movement of the drift.

It is advantageous to mount the handle 26 in such a way that the cam face 25 has its face on the pivotal axis of the lever 26 at the start of an advancing movement of the drift, and to achieve this the lever 26 is carried on pins 29 which engage a pair of discs 30 housed in apertures in the wings 4 and 5 of the body 1, assembly being readily allowed in that the lever 26 can be positioned between the two wings 4 and 5 of the body and the pins 29 inserted to connect the handle to the discs 30, the discs 30 thus forming prt of the handle 26.

The drift 15 with the push rod 17 linked to it by the pin 18 can similarly be positioned through the space between the wings 4 and 5 of the body 1 and are then located in place when the handle 26 is positioned between the wings 4 and 5 and the pins 29 inserted into the discs 30. The pins 29 can be a push fit into the discs 30.

From the foregoing it will be realised that a highly effective action results when the cam face 25 on the second handle 26 is generated about a transverse pivotal axis for the handle 26 and in which the hinge pin 18 between the drift 15 and the push rod 17 has its axis parallel to the ivotal axis of the handle 26, and in which both of the axes intersect at right angles the axis of movement 28 of the drift 15.

It will be realised that many variations in construction of the invention are possible, and it will be appreciated for instance that the push rod 17 and the cam face 25 of the lever 26 are merely in frictional contact during the advancing action of the drift 15. During this action there is a rolling motion of the cam face 25 of the handle 26 on the face 27 of the push rod 17, but it should also be realised that the face 27 of the push rod 17 need not be arcute about the pin 18 as is shown in the illustrations, but this face 27 can itself be cam shaped in association with the cam face 25.

Similarly, as is stated earlier herein, it is already known that where a long stroke is required it is possible to move the pivoting axis of the movable handle 26 forward for a multi-stroke action on the drift, and such an arrangement could also be applied to the present invention by so mounting the discs 30 that they have two operating positions, but generally this is not necessary because of the greatly reduced friction which exists under the arrangement which forms the subject of this invention and because a relatively long stroke of the movable handle is possible which the push rod arrangement can conveniently accommodate.

It will be realised from the foregoing that the invention is highly advantageous in that firstly there is low friction etween the drift 15 and the body 1 in which it is supported because of the absence of side thrust previously existing with cam arrangements, and secondly there is no significant frictional loss between the cam face 25 and the face 27 of the push rod 17 because of the rolling action of the cam face 25 on the push rod. As stated, it is also advantageous to commence the forward transverse of the drift 15 from the axis of rotation of the movable handle 26 as this reduces arcuate movement of the push rod to a minimum.

The claims defining the invention are as follows.

I claim:

1. A tube expanding tool comprising a body having a first handle secured thereto and a second movable handle pivotally carried thereby and a drift axially slidable therein into expandable jaws carried in a head mountable on the said body whereby to expand the said jaws when the said drift is moved thereinto, characterised by a push rod hingedly connected to said drift about a pin having its axis parallel to the axis of movement of the said second handle, the said push rod having an arcuate face positioned to engage a cam face on said movable handle in a position on, or substantially on, the axis of movement of the said drift, said pin being encircled by a helical spring one end of which connects to the said push rod and the other end of which connects to the said drift, said spring being loaded to move the said push rod into a starting position in relation to the said drift when there is no frictional contact between said cam face and said push rod and allowing progressive forward movement of said drift by successive strokes of said handle which has the said cam on it.

2. A tube expanding tool according to claim 1 characterised in that the said cam face on the said movable handle is positioned on or substantially on the axis of articulation of the said second handle at the commencement of forward transverse of the said drift during an expanding stroke.

3. A tube expanding tool according to claim 1 or 2 characterised in that the said push rod has a face arcuate about the said pin which forms the hinged connection to the said drift.

4. A tube expanding tool according to claim 1 characterised in that the said push rod is hingedly connected to the said drift by the said pin which is in parallel alignment with the rotational axis of the said second handle and is urged into a starting position in relation to the said second pivoted handle when the said handle is in the starting position prior to the commencement of a forward movement of the drift into the said jaws, the said push rod being urged into a starting position each time the said cam is disengaged by return of the said handle by the helical spring encircling the said pin and connected at one end to the said push rod and to the other end to the said drift and loaded to urge the said push rod into the said starting position, and further characterised in that thrust exerted by the push rod due to the cam action is taken by interengaging shoulders on the said push rod and on the said drift which are arcuate about the said pin whereby to transmit the stress mainly through the said shoulders.

5. A tube expanding tool according to preceding claim 1 characterised in that the said body comprises a main part having extending from it a pair of parallel spaced-apart wings with the space therebetween communicating with a bore axially disposed through the said body wherein to support the said drift, the said space accommodating the said push rod and the mounting end of the said second pivoted handle, and a screw thread on said body to engage a head which carries the said jaws when the said head is positioned on the said body, the pivotal axis between the said push rod and the said drift being tansverse to the said cavity and parallel to the pivotal axis of the said second handle.

6. A tube expanding tool according to claim 5 characterised in that the said second handle is secured to a pair of discs one rotationally located in one of the said wings and the other in the other of the said wings, and pins joining the said handle to the said discs, the said cam face on the said second handle being generally disposed in the space between the said discs whereby the cam-engaging face on the said push rod operates at least initially between the said discs.

7. A tube expanding tool according to claim 1 further characterised in that the said cam face on the said second handle is generated about a transverse pivotal axis for the handle on the said body, and in that the said hinge between the said drift and te said push rod has its axis in parallel alignment with the said pivotal axis of the said second handle, and further that both the said axes intersect at right angles the axis of movement of the said drift, the said push rod having on it remote from its pivotal axis an arcuate face arranged to engage said cam face.

8. A tube expanding tool according to claim 1 characterised in that the said arcuate face is generated about the pivotal axis between the said drift and the said push rod, and in that the said arcuate face is on or substantially on the pivotal axis of the said second handle.

* * * * *